United States Patent [19]

Asano et al.

[11] 4,112,880

[45] Sep. 12, 1978

[54] METHOD OF AND MIXTURE CONTROL SYSTEM FOR VARYING THE MIXTURE CONTROL POINT RELATIVE TO A FIXED REFERENCE

[75] Inventors: Masaharu Asano; Shunichi Kadowaki, both of Yokohama, Japan

[73] Assignee: Nissan Motor Company, Limited, Japan

[21] Appl. No.: 752,962

[22] Filed: Dec. 21, 1976

[30] Foreign Application Priority Data

Dec. 27, 1975 [JP] Japan ..... 51-155767
Dec. 27, 1975 [JP] Japan ..... 51-155768

[51] Int. Cl.[2] ..... F02B 3/08; F02M 7/12; F01N 3/08

[52] U.S. Cl. ..... 123/32 EE; 123/119 EC; 123/32 EA; 60/276; 60/285

[58] Field of Search ..... 123/32 EE, 32 EA, 119 EC; 60/276, 285

[56] References Cited

U.S. PATENT DOCUMENTS

| | | | |
|---|---|---|---|
| 3,831,564 | 8/1974 | Schmidt et al. | 123/32 EE |
| 3,919,983 | 11/1975 | Wahl et al. | 60/276 |
| 3,990,411 | 11/1976 | Oberstadt et al. | 60/276 |
| 3,998,189 | 12/1976 | Aoki | 60/276 |
| 4,015,563 | 4/1977 | Drews et al. | 123/32 EA |
| 4,019,474 | 4/1977 | Nishimiya et al. | 123/32 EE |
| 4,023,357 | 5/1977 | Masaki | 60/276 |
| 4,029,061 | 6/1977 | Asano | 60/276 |

FOREIGN PATENT DOCUMENTS

| | | | |
|---|---|---|---|
| 2,304,784 | 10/1976 | France | 123/119 EC |

*Primary Examiner*—Charles J. Myhre
*Assistant Examiner*—Parshobam S. Lall

[57] ABSTRACT

A control point of a closed loop mixture control system for an internal combustion engine is varied by extending the duration of a signal representative of the deviation of air-fuel ratio from a preset value, or by alternately supplying an engine speed representative pulse sequence in opposite polarities to a first and a second output terminal. An integrator is connected to respond to the duration-extended deviation signal or connected to the first and second output terminals to effect integration of the alternatively supplied, opposite-polarity pulses to generate a stepwise voltage waveform. The integrator output is used as a feedback control signal which fluctuates about a level differing from the present value to shift the control point of the closed loop corresponding to said difference.

10 Claims, 15 Drawing Figures

METHOD OF AND MIXTURE CONTROL SYSTEM FOR VARYING THE MIXTURE CONTROL POINT RELATIVE TO A FIXED REFERENCE

The present invention relates generally to an electronic closed loop air-fuel ratio control system for use with an internal combustion engine, and particularly to an improvement in such a system for optimally controlling an air-fuel mixture fed to the engine regardless of a caracteristic of an exhaust gas sensor employed.

Various systems have been proposed to supply an optimal air-fuel mixture to an internal combustion engine in accordance with the mode of engine operation, one of which is to utilize the concept of an electronic closed loop control system based on a sensed concentration of a component in exhaust gases of the engine.

According to the conventional system, an exhaust gas sensor, such as an oxygen analyzer, is deposited in an exhaust pipe for sensing a component of exhaust gases from an internal combustion engine, generating an electrical signal representative of the sensed component. A differential signal generator is connected to the sensor for generating an electrical signal representative of a differential between the signal from the sensor and a reference signal. The reference signal is previously determined in due consideration of, for example, an optimum ratio of an air-fuel mixture to the engine for maximizing the efficiency of both the engine and an exhaust gas refining means. A so-called proportional-integral (p-i) controller is connected to the differential signal generator, receiving the signal therefrom. A pulse generator is connected to the p-i controller, generating a train of pulses which is fed to an air-fuel ratio regulating means, such as electromagnetic valves, for supplying an air-fuel mixture with an optimum air-fuel ratio to the engine.

In the previously described conventional control system, however, a problem is encountered as follows. That is, when an exhaust gas sensor such as an $O_2$ sensor is employed, it is very difficult to change the central value of an integration circuit of the p-i controller. This is because the output of the sensor abruptly changes at a specified air-fuel ratio. As a consequence, in the case where one engine requires a specified air-fuel ratio for effective reduction of one or more noxious components, the conventional system could not deal with this requirement.

It is therefore an object of the present invention to provide an improved electronic closed loop control system for removing the above described inherent defect of the conventional system.

Another object of the present invention is to provide an improved electronic closed loop air-fuel ratio control system which includes a delay circuit for optimal control of the air-fuel ratio notwithstanding a characteristic of an exhaust gas sensor employed.

Still another object of the present invention is to provide an improved electronic closed loop air-fuel ratio control system which includes a logic circuit for optimal control of the air-fuel ratio.

These and other objects, features and many of the attendant advantages of this invention will be appreciated more readily as the invention becomes better understood by the following detailed description, wherein like parts in each of the several figures are identified by the same reference characters, and wherein:

FIG. 1 schematically illustrates a conventional electronic closed loop air-fuel ratio control system for regulating the air-fuel ratio of the air-fuel mixture fed to an internal combustion engine;

Figure 5:
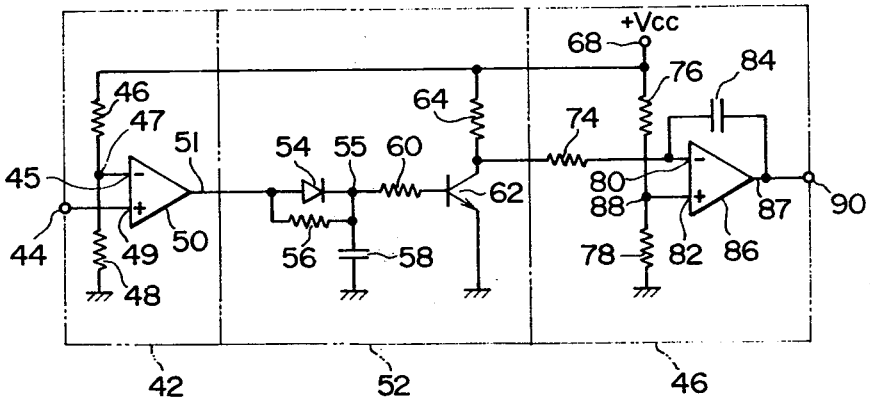
FIG. 5 is a circuit diagram illustrating a first preferred embodiment of the present invention.
Figure 6A:
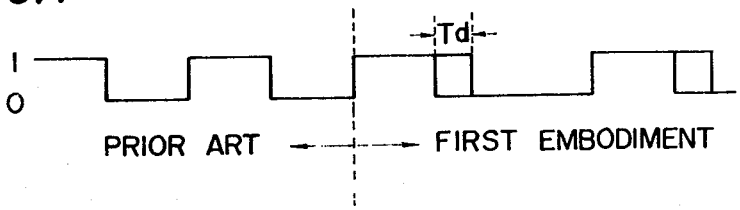
Figure 6B:
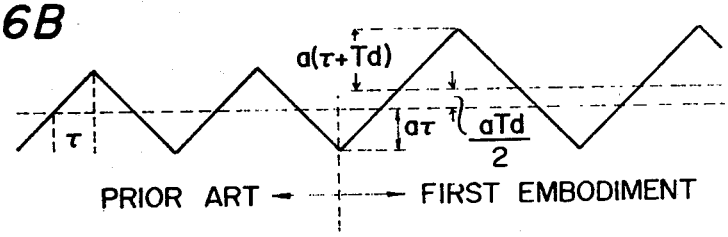
Figure 6A:
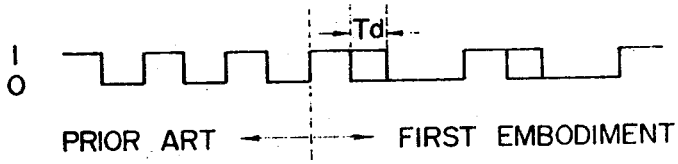
Figure 6B:
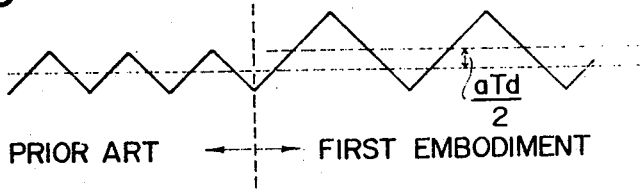
Figure 7A:
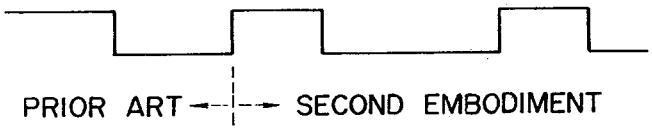
Figure 7B:
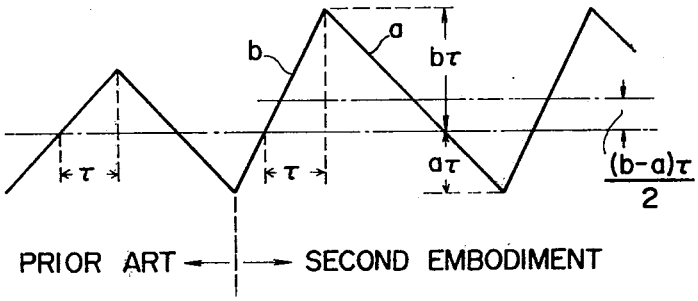
Figure 7A:
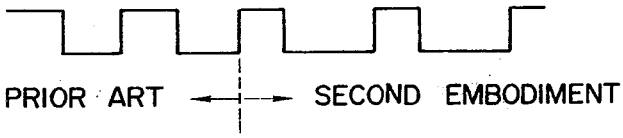
Figure 7B:
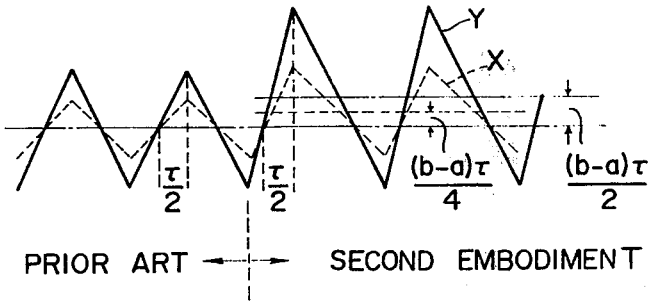
Figure 8:
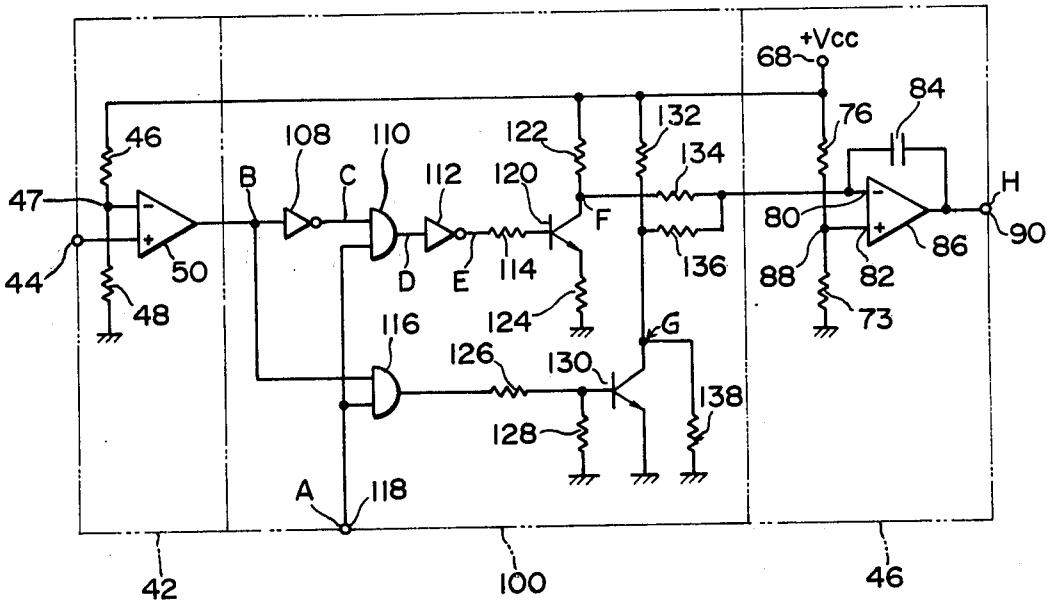

FIGS. 6A–6B' are graphs showing wave forms of signals appearing at several parts of FIG. 5;

FIGS. 7A–7B' are graphs showing a principle of a second preferred embodiment;

FIG. 8 is a circuit diagram illustrating a second preferred embodiment; and

FIGS. 9A–9E' are graphs showing wave forms of signals appearing at several parts of FIG. 8.

Figure 1:
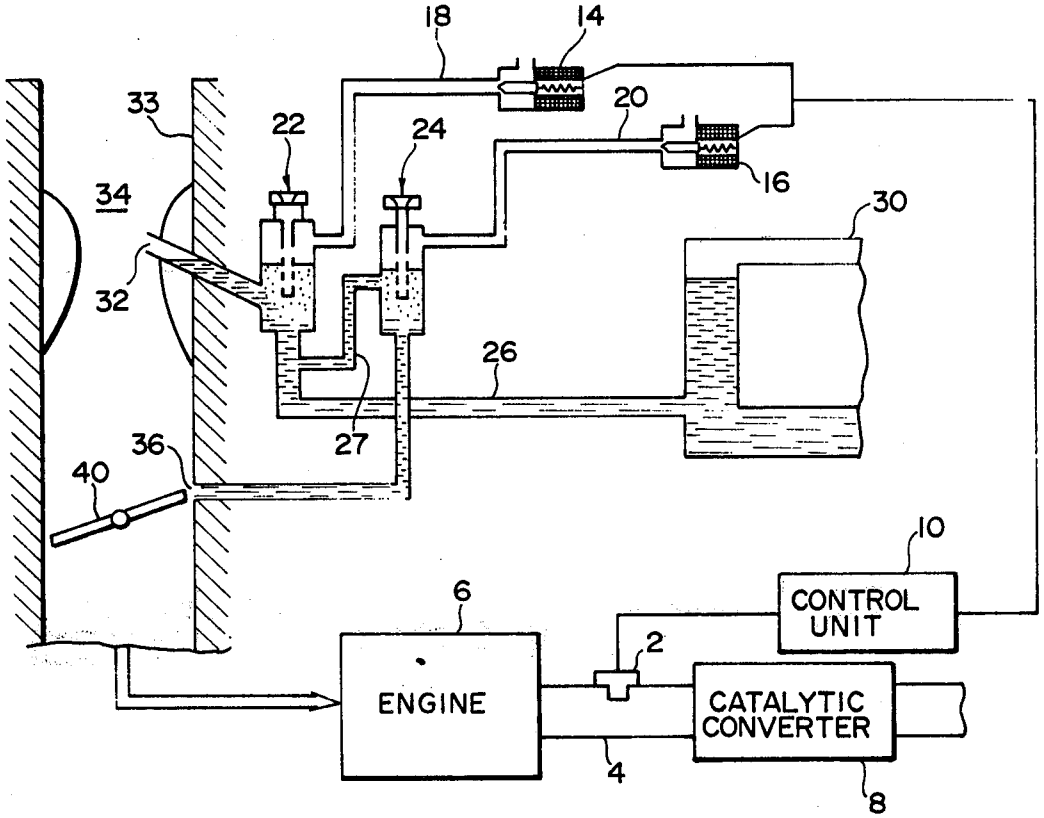

Reference is now made to drawings, first to FIG. 1, which schematically exemplifies in a block diagram a conventional electronic closed loop control system with which the present invention is concerned. The purpose of the system of FIG. 1 is to electrically control the air-fuel ratio of an air-fuel mixture supplied to an internal combustion engine 6 through a carburetor (no numeral). An exhaust gas sensor 2, such as an oxygen, CO, HC, $NO_x$, or $CO_2$ analyzer, is disposed in an exhaust pipe 4 in order to sense the concentration of a component in exhaust gases. An electrical signal from the exhaust gas sensor 2 is fed to a control unit 10, in which the signal is compared with a reference signal to generate a signal representing a differential therebetween. The magnitude of the reference signal is previously determined in due consideration of an optimum air-fuel ratio of the air-fuel mixture supplied to the engine 6 for maximizing the efficiency of a catalytic converter 8. The control unit 10, then, generates a command signal, or in other words, a train of command pulses based on the signal representative of the differential. The command signal is employed to drive two electromagnetic valves 14 and 16. The control unit 10 will be described in more detail in conjunction with FIG. 2.

The electromagnetic valve 14 is provided in an air passage 18, which terminates at one end thereof at an air bleed chamber 22, to control a rate of air flowing into the air bleed chamber 22 in response to the command pulses from the control unit 10. The air bleed chamber 22 is connected to a fuel passage 26 for mixing air with fuel delivered from a float bowl 30 and supplies air-fuel mixture to a venturi 34 through a discharging (or main) nozzle 32. Electromagnetic valve 16 is provided in another air passage 20, which leads to air bleed chamber 24, controls the rate of air supplied to the air bleed chamber 24 in response to the command pulses from the control unit 10. The air bleed chamber 24 is also connected to the fuel passage 26 through a fuel branch passage 27 for mixing air with fuel from the float bowl 30 and supplies air-fuel mixture to an intake passage 33 through a slow nozzle 36 adjacent to a throttle 40. As shown, the catalytic converter 8 is provided in the exhaust pipe 4 downstream of the exhaust gas sensor 2. In case where, for example, a three-way catalytic converter is employed, the electronic closed loop control system is designed to set the air-fuel ratio of the mixture to a point at or near stoichiometry. This is because the conversion efficiency of the three-way catalytic converter is maximized when the air-fuel mixture ratio is set at such point.

Figure 2:
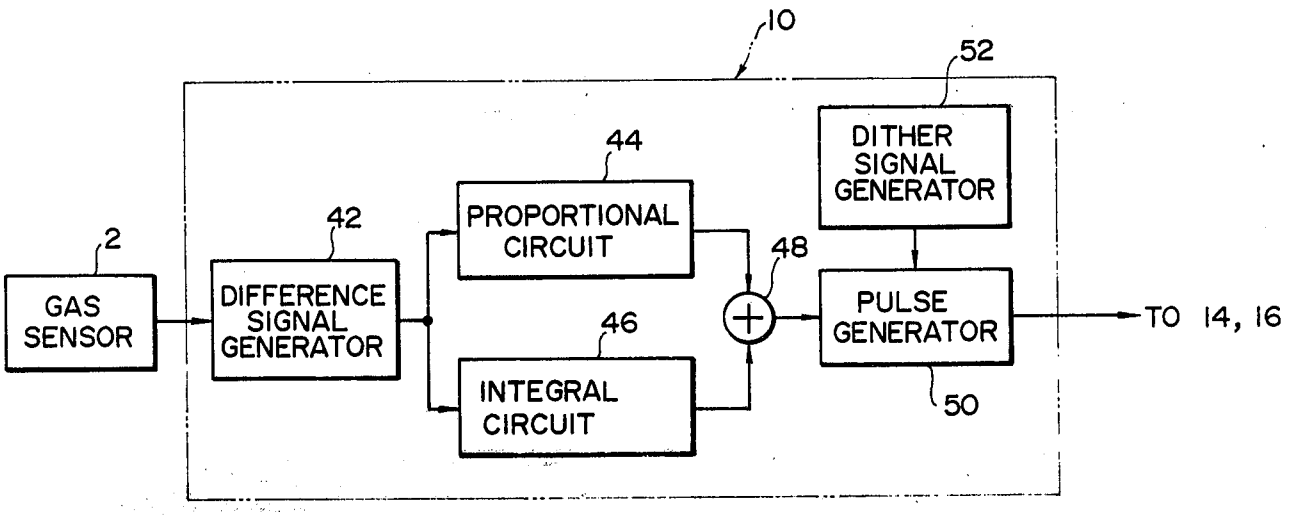
FIG. 2 is a detailed block diagram of an element of the system of FIG. 1.

Reference is now made to FIG. 2, in which the control unit 10 is schematically illustrated. The signal from the exhaust gas sensor 2 is fed to a difference detecting circuit 42 of the control unit 10, which circuit compares the incoming signal with a reference one to generate a signal representing a difference therebetween. The signal from the difference detecting circuit 42 is then fed to two circuits, viz., a proportional circuit 44 and an integration circuit 46. The purpose of the provision of the circuits 44 and 46, as is well known to those skilled in the art, is to increase the response characteristics of the system and to stabilize the operation of the system. The circuit 46 generates an integrated signal which is used for generating the command pulses in a pulse generator 50. The signals from the circuit 44 and 46 are then fed to an adder 48 to provide algebraical summation of the two signals. The signal from the adder 48 is then applied to the pulse generator 50 to which a dither signal is also fed from a dither signal generator 52. The command signal, which is in the form of pulses, is fed to the valves 14 and 16, thereby to control the "on" and "off" operation thereof.

In FIGS. 1 and 2, the electronic closed loop air-fuel ratio control system is illustrated together with a carburetor, however, it should be noted that the system is also applicable to a fuel injection device.

Figure 3:
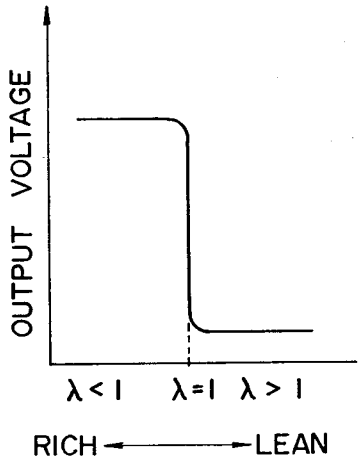
FIG. 3 is a graph showing an output voltage of an $O_2$ sensor as a function of an air-fuel ratio.

Reference is now made to FIG. 3, which is a graph showing an output voltage of an $O_2$ sensor as a function of an air-fuel ratio ($\lambda$), wherein $\lambda = 1$ corresponds to stoichiometry. As seen from FIG. 3, the output voltage of the $O_2$ sensor abruptly changes in the vicinity of the stoichiometry. This means that the signal from the difference signal generator 42 is an indication of whether the air-fuel ratio is greater or smaller than stoichiometry, i.e. $\lambda = 1$.

Figure 4:
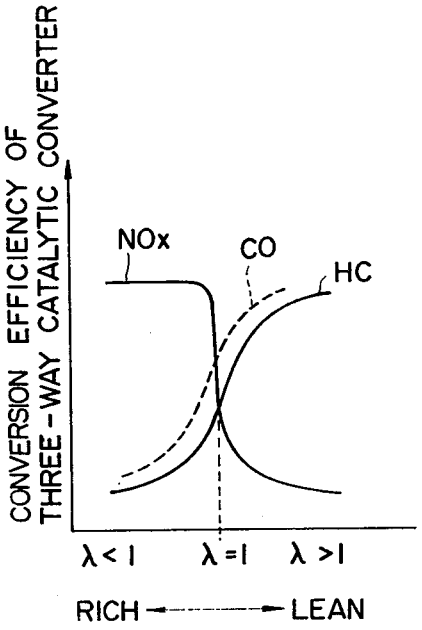
FIG. 4 is curves showing conversion efficiency of a three-way catalytic converter as a function of air-fuel ratio.

FIG. 4 is a graph illustrating a conversion efficiency of a three-way catalytic converter as a function of an air-fuel ratio. It will be seen that the converter efficiency is maximized in the vicinity of the stoichiometry. However, it is often the case that a certain type of engine requires a greater reduction $NO_x$ than for other types of engine. In such a case it is impossible, provided that the $O_2$ sensor is used as an exhaust gas sensor, shift change the air-fuel mixture ratio to the richer side with respect to the stoichiometry ($\lambda = 1$) in order to meet the requirement. The above discussion also applies to a situation in which another type of engine requires a greater reduction of HC and/or CO. It is thus impossible to meet the specific needs of a particular engine for effective reduction of one or more noxious components.

The present invention is therefore to remove the above described inherent defect of the prior art.

Reference is now made to FIG. 5, which illustrates a first preferred embodiment of the present invention. In this embodiment a delay circuit 52 is provided between the difference signal generator 42 and the integration circuit 53. The non-inverting input terminal 49 of an operational amplifier 50 is connected through a terminal 44 to the exhaust gas sensor 2 (FIG. 2). The inverting terminal 45 of the operational amplifier 50 is connected to a junction 47 between resistors 46 and 48. The resistors 46 and 48 are connected in series between a terminal 68 and ground, supplying a divided voltage to the terminal 47. The terminal 68 is connected to a d.c. power source (not shown) the voltage of which is denoted by reference character $V_{cc}$. The output terminal 51 of the operational amplifier 50 is connected to the anode of a diode 54 whose cathode is connected to one terminal of a capacitor 58. The other terminal of the capacitor 58 is connected to ground. A resistor 56 is connected across the diode 54. The resistor 56, the diode 54, and the capacitor 58 form an integration circuit. Charges from the operational amplifier 50 is fed to the capacitor 58, mainly through the diode 54, while the operational amplifier 50 generates a signal indicating a logic "1". The stored charges are then discharged through the resistor 56 while the operational amplifier 50 generates a signal indicative of a logic "0". In the above, the forwarding resistance of the diode 54 is much less than that of the resistor 56, so that the charging time constant is much smaller than the discharge time constant. This means that a voltage appearing at a junction 55 between the diode 54 and capacitor 58 increases at a higher rate than the rate at which it decreases. The junction 55 is connected through a resistor 60 to the base of a transistor 62. The collector of the transistor 62 is connected to the terminal 68 through a resistor 64, and the emitter thereof to ground. The transistor 62 is rendered conductive at the instant the signal from the operational amplifier 50 generates a logic "1", and remains conductive until the voltage appearing at the junction 55 falls below the threshold of the transistor 62, even if the output from the amplifier 50 changes to a logic "0". The collector of the transistor 62 is connected through a resistor 74 to a inverting terminal 80 of an operational amplifier 86 with a feedback capacitor 84. The noninverting terminal 82 of the operational amplifier 86 is connected to a junction 88 between resistors 76 and 78. The resistors 76 and 78, connected in series between the terminal 68 and ground, supplies a constant voltage to the noninverting terminal 82. An output terminal 87 of the operational amplifier 86 is connected through an output terminal 90 and thence to the adder 48 (FIG. 2).

The operation of the first preferred embodiment will be described by reference to FIGS. 6A–6B'. FIGS. 6A and 6B are graphs respectively showing wave forms of outputs of the amplifiers 50 and 90, where $T_d$: a delay time resulting from the insertion of the delay circuit 52, $\tau$: a delay time of the feedback loop and "$a$": a gradient of each of an ascending and a descending slope as determined by the time constant of the resistor 56 and the capacitor 58. If the delay circuit 52 is not provided, the central value of the output 90 of the amplifier 87 is $a\tau + \alpha$, where $\alpha$ denotes a minimum value. However, hereinafter, $\alpha$ is neglected and the central value is assumed to be a $\tau$ for convenience. The introduction of a delay time $T_d$ (FIG. 6A) results in corresponding integrated waveform having a greater amplitude than the amplitude "$a\tau$" of the previously integrated waveform by an amount $aT_d$ (FIG. 6B) from the following equation;

$$\frac{2a\tau + aT_d}{2} - 2\tau = \frac{2T_d}{2} \qquad (1)$$

Since $a$ and $T_d$ are of constant values, the amount of deviation of the control point from the value $a\tau$ is constant regardless of engine speed as seen in FIGS. 6A'–6B.

In FIG. 5, if the diode 54 is arranged such that its polarity is inverted, the central value becomes below "$a\tau$" by $aT_d/2$.

It is therefore understood from the foregoing that the central value can be changed with change of the delay time $T_d$.

Reference is now made to FIGS. 7A–7B', which are graphs showing the principle of a second preferred embodiment of the present invention in comparison with that of the prior art. FIG. 7A shows a wave form of the output of the difference signal generator 42 in FIG. 2, and FIG. 7B shows that of the integration circuit 46 in FIG. 2. According to the prior art, gradients of an ascending and a descending slope are equal to each other, so that the central value of the output of the integration circuit 46 is not changeable. More specifically, as shown in FIG. 7B, provided that each of the gradients is "$a$", then, the central value is assumed to be $a\ \tau$ as previously referred to. However, according to the second preferred embodiment, the gradients of the ascending and the descending slope are different from each other, that is, for example, "$b$" and "$a$" as shown in FIG. 7B. Consequently, the central value becomes $(a + b)\ \tau/2$, and the deviation from "$a\ \tau$" is $$\frac{(a+b)\tau}{2} - 2\tau = \frac{(b-a)\tau}{2} \qquad (2)$$

It is therefore understood from the Equation (2) that, since the value of $\tau$ changes with engine speed or an amount of intake air, if the gradients "$a$" and "$b$" are constant, then the deviation undesirably changes. For example, as shown in FIG. 7A', if the engine speed increases to a value twice that shown to the left of the Figure, the amount of deviation of the central value of the waveform X is $(b - a)\ \tau/4$ which is one half the previous value (Equation 2). In order to remove this undesirable fluctuation of the central value of the waveform, the gradients "$a$" and "$b$" are designed to vary inversely proportional to $\tau$ to compensate for such fluctuation. In practice the gradients "$a$" and "$b$" are varied with engine speed, while maintaining the ratio of "$b$" to "$a$" constant so that waveform Y results. It is seen that the deviation of the control point is $(b - a)\ \tau/2$ as seen in FIG. 7B'.

In FIGS. 7B and 7B', the gradient "$b$" is greater than "$a$", however, when the central value should be below "$a\ \tau$" by $aT_d/2$, the gradient "$b$" is made less than "$a$".

Reference is now made to FIG. 8 which shows a circuit diagram of the second preferred embodiment. The second preferred embodiment is characterized by the provision of a gating circuit 100 between the difference signal generator 42 and the integration circuit 46 in order to change the gradients "$a$" and "$b$" depending upon the engine speed.

FIGS. 9A–9H denote wave forms of signals appearing at circuit components indicated by reference characters A–H in FIG. 8, respectively.

Figure 9A:
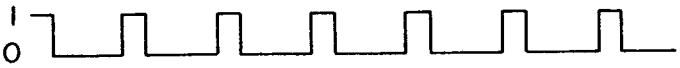
Figure 9B:
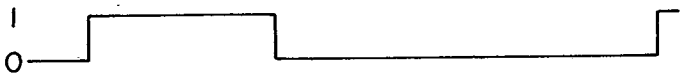
Figure 9C:
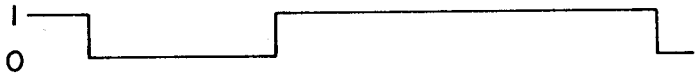
Figure 9D:
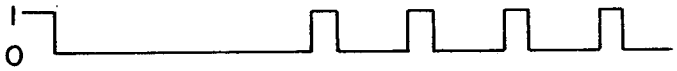
Figure 9E:
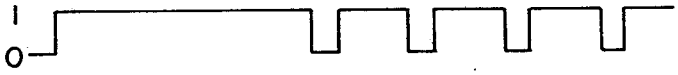

The gating circuit 100 receives a pulsating signal at frequency indicative of engine speed through a terminal 118. The wave form of the received signal is shown in FIG. 9A. This signal is then fed to two AND gates 110 and 116. On the other hand, the operational amplifier 50 supplies its output to both the AND gate 116 and an inverter 108. The wave form of the output of the amplifier 50 is shown in FIG. 9B. The inverter 108 inverts the poralities of the received signal, supplying the inverted signal to the AND gate 110 which in turn generates a signal as shown in FIG. 9D. The signal from the AND gate 110 is fed to an inverter 112 wherein the supplied signal is inverted. The inverter 112 generates a signal as shown in FIG. 9E, which signal is then fed through a resistor 114 to the base of a transistor 120. The transistor 120 is rendered conductive when the signal from the inverter 112 indicates a logic "1". The emitter of the transistor 120 is through a resistor 124 connected to ground and the collector thereof to both the terminal 68 through a resistor 122 and the terminal 80 of an operational amplifier 86 through resistors 134 and 74. Whilst, the output terminal (no numeral) of the AND gate 116 is connected to the base of a transistor 130 through a resistor 126. The base is connected to ground through a resistor 128. The emitter of the transistor 130 is connected to ground, and the collector thereof is connected to the terminal 68 through a resistor 132 and to ground through a resistor 138 and furthermore to the reversing terminal 80 of an operational amplifier 86 through a resistors 136.

Figure 9F:
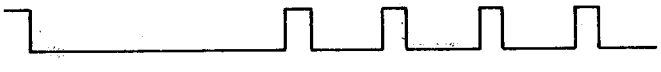
Figure 9G:
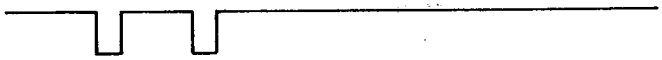

In response to the deviation signal from circuit 42 being at high and low voltage levels, AND gates 116 and 110 are rendered alternately conductive to pass the engine speed pulses to the associated transistors gate electrodes so that transisters 130 and 120 are turned on and off alternately to generate voltage waveforms as illustrated in FIGS. 9F and 9G at the collector electrodes of the respective transistors. Therefore, when the transistor 120 is non-conductive (that is, the collector voltage is high), the output of the operational amplifier 86 decreases and when the transistor 130 is conductive (that is, the collector voltage is low), the output of the operational amplifier 86 increases as shown in FIG. 9H.

Figure 9H:
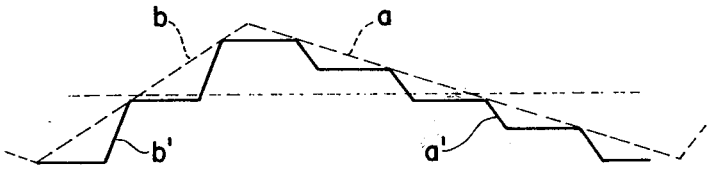
Figure 9A:
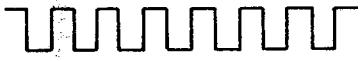
Figure 9B:
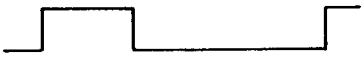
Figure 9C:
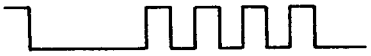
Figure 9D:
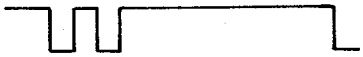
Figure 9E:
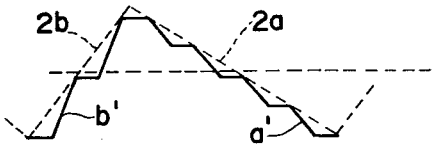

In FIG. 9H, a gradient "$b'''$" of an ascending slope is previously determined by the time constant of the resistor 136 and the capacitor 84, and on the other hand, a gradient "$a'''$" of a descending slope of the time constant of the resistor 136 and the capacitor 84.

During the interval between successive engine speed pulses, the voltage level of the output of amplifier 86 remains unchanged so that its output varies in a stepwise manner as illustrated in FIG. 9H with each step increasing at $a$ rate $b'$ and decreasing at $a$ rate $a'$.

As shown in FIG. 9A', if the engine speed is twice that of the case of FIG. 9A, the output of the terminal 90 has a wave form as shown in FIG. 9E', wherein the gradients "$b'''$" and "$a'''$" are constant for each increment and each steady state period of the increment is halved, each of the overall gradients of the envelope is just twice that of the waveform of FIG. 9H. FIGS. 9B', 9C', and 9D' correspond to FIGS. 9B, 9D, and 9G, respectively.

As seen from FIG. 9H, the gradient "$b$" is greater than "$a$". This means that the resistance of the resistor 134 is greater than that of the resistor 136. Therefore, in case where a higher rate voltage increment is desired, the resistance of the resistor 134 should be less than that of the resistor 136.

Furthermore, the first and the second embodiments each can be used with or without proportional circuit 44.

It is therefore apparent from the foregoing that, according to the present invention, the control point of the feedback loop ratio can be easily changed to meet the specific reduction requirements of a particular.

What is claimed is:

1. A mixture control system for an internal combustion engine including means for supplying mixture of air and fuel thereto in a variable ratio depending upon a signal representative of the concentration of a predetermined constituent gas of the emissions from said engine, and an exhaust gas sensor for generating said signal having a sharp transition in amplitude in response to the presence of said predetermined constitutent gas being above or below a predetermined value corresponding to an air-fuel ratio at or near stoichiometry, comprising:

means for generating a deviation signal representative of the deviation of said transitional signal from a reference representing said predetermined air-fuel ratio, said deviation signal having first and second voltage levels depending upon whether said transitional signal is above or below said predetermined value;

means for extending the duration of said deviation signal at said first voltage level a predetermined time; and means for integrating said duration-extended deviation signal with time to generate a time integral signal.

2. A mixture control system as claimed in claim 1, wherein said duration extending means comprises a resistor and a capacitor connected in a series circuit to the output of said deviation signal generating means, a diode connected between said resistor to charge said capacitor in the presence of said deviation signal being at said first voltage level, and a transistor having a control electrode connected to be responsive to a voltage developed across said capacitor, and first and second controlled electrodes, a voltage developed across said first and second controlled electrodes being connected to said integration means.

3. An mixture control system for an internal combustion engine including means for supplying mixture of air and fuel thereto in a variable ratio depending upon a signal representative of the concentration of a predetermined constituent gas of the emissions from said engine, and an exhaust gas sensor for generating said signal having a sharp transition in amplitude in response to the presence of said predetermined constituent gas being above or below a predetermined value corresponding to an air-fuel ratio at or near stoichiometry, comprising:

deviation signal generating means for generating a deviation signal representative of the deviation of said transitional signal from a reference representing said predetermined air-fuel ratio, said deviation having first and second voltage levels depending upon whether said transitional signal is above or below said predetermined value;

pulse generating means for generating a pulse sequence with pulses occurring at a rate variable with the speed of said engine;

switching circuit means for alternately supplying said pulse sequence to a first output terminal in response to the presence of said deviation signal being at said first voltage level and supplying said pulse sequence to a second output terminal in response to the presence of said deviation signal being at said second voltage level with a polarity opposite to the polarity of the pulse sequence at said first output terminal; and integration means connected to said first and second output terminals to receive said pulse sequences at alternate intervals for providing integration of the received pulses with time.

4. A mixture control system as claimed in claim 3, wherein said integration means comprises a first and a second resistor respectively connected to said first and second output terminals of said switching circuit means and a capacitor connected to said first and second resistors to form a first integrating time constant circuit with said first resistor in response to the presence of said deviation signal being at the first voltage level and a second integrating time constant circuit with said second resistor in response to the presence of said deviation signal being at the second voltage level.

5. A mixture control system as claimed in claim 4, wherein said integration means comprises an operational amplifier having first and second input terminals and an output terminal, said capacitor being connected between said first input terminal and output terminal of said operational amplifier, and said second input terminal being connected to a reference voltage source.

6. A mixture control system as claimed in claim 5, wherein said switching circuit means comprises a first gating channel including a first inverter connected to the deviation signal generating means, an AND gate connected to the output of the inverter and to said pulse generating means, a second inverter connected to the output of the AND gate and a switching device responsive to the output of the second inverter, said switching circuit means further comprising a second gating channel including a second AND gate connected to the output of said deviation signal generating means and to said pulse generating means and a switching device responsive to the output of said second AND gate, the output of the switching devices of said first and second channels being connected to said first and second resistors respectively for application of said pulses through said first and second resistors to the first input terminal of said operational amplifier.

7. An electronic closed loop air-fuel ratio control system for supplying an optimum air-fuel mixture to an internal combustion engine, which system comprises in combination:

an air-fuel mixture supply assembly;

an exhaust pipe;

an exhaust gas sensor provided in the exhaust pipe for sensing a concentration of a component in exhaust gases and generating a signal representative thereof;

a difference signal generator connected to the exhaust gas sensor, for receiving the signal therefrom, and generating a signal representative of a difference between magnitudes of the signal from the exhaust gas sensor and a reference threshold;

an integration circuit connected to the difference signal generator for integrating the same;

an actuator provided in the air-fuel mixture assembly responsive to the integrated signal from the integration circuit to control the air-fuel ratio of an air-fuel mixture fed to the engine; and two switching means connected to the integration circuit for respectively controlling the gradient of an ascending and a descending slope of the signal from the integration circuit by "on" and "off" operation thereof;

an inverter provided with an input and an output terminal, the input terminal connected to the difference signal generator for receiving the signal therefrom;

an operation mode receiving terminal for receiving a signal representative of the at least one engine operation mode;

an AND gate provided with two input terminals and an output terminal, one of the two input terminals connected to the output terminal of the inverter and the other input terminal to the operation mode receiving terminal;

another inverter provided with an input and an output terminal, the input terminal connected to the output terminal of the AND gate and the output terminal to the base of one of two transistors; and another AND gate provided with two input terminals and an output terminal, the two input terminals being respectively connected to the difference signal generator and to the operation mode receiving terminal, and the output terminal connected to the base of other of the two transistors.

8. An electronic closed loop air-fuel ratio control system as claimed in claim 7, wherein the resistances of the two switching means are different from each other.

9. A method of operating a closed-loop mixture control system at a desired air-fuel ratio in an internal combustion engine including an exhaust gas sensor operable to generate a signal having a sharp transition in amplitude between first and second voltage levels in response to the presence of a predetermined constituent gas being above or below a predetermined concentration in the emissions from said engine, comprising: the steps of comparing the transitional signal with a reference level representing a predetermined air-fuel ratio to generate a signal representing the deviation of said transitional signal from said reference level; integrating said deviation signal with time to generate a time integral signal having an amplitude varying in accordance with the direction of said deviation; and extending the duration of said deviation signal by a predetermined amount prior to said integration to permit said time integral signal to increase in amplitude corresponding to said predetermined amount, whereby said time integral signal fluctuates about a level different from said predetermined air-fuel ratio.

10. A method as claimed in claim 9, wherein the step of extending the duration of said deviation signal comprises charging a capacitor in response to said deviation signal being at said first voltage level through a diode and discharging the stored energy in said capacitor through a resistor in response to said deviation signal being at said second voltage level.

* * * * *